US006578207B1

(12) United States Patent
Fratilla

(10) Patent No.: US 6,578,207 B1
(45) Date of Patent: Jun. 17, 2003

(54) RETURN JET FITTING FOR POOLS AND SPAS

(76) Inventor: Eric L. Fratilla, 219 Pocahontas Ct., Henderson, NV (US) 89074-4194

( * ) Notice: Subject to any disclaimer, the term of this patent is extended or adjusted under 35 U.S.C. 154(b) by 0 days.

(21) Appl. No.: 10/065,366

(22) Filed: Oct. 9, 2002

Related U.S. Application Data

(60) Provisional application No. 60/327,966, filed on Oct. 9, 2001.

(51) Int. Cl.[7] ..... E04H 4/00

(52) U.S. Cl. ..... 4/492; 4/541.1; 4/507

(58) Field of Search ..... 4/492, 506, 507, 4/541.1–541.6, 567, 568, 490; 239/587.1–587.4, 548, 566, 567

(56) References Cited

U.S. PATENT DOCUMENTS

| | | | | | |
|---|---|---|---|---|---|
| 3,605,735 | A | * | 9/1971 | Soden | 601/169 |
| 3,677,474 | A | * | 7/1972 | Lorenzen | 239/587.4 |
| 3,698,431 | A | | 10/1972 | Thompson | 137/604 |
| 4,212,088 | A | | 7/1980 | Goettl et al. | 4/490 |
| 4,520,514 | A | | 6/1985 | Johnson | 4/490 |
| 4,941,217 | A | * | 7/1990 | Tobias et al. | 4/541.6 |
| 5,392,472 | A | * | 2/1995 | Maxfield | 4/512 |
| 5,769,259 | A | | 6/1998 | Revill et al. | 220/284 |
| 5,862,543 | A | | 1/1999 | Reynoso et al. | 4/541.6 |
| 5,915,849 | A | | 6/1999 | Dongo | 4/541.6 |
| 5,926,865 | A | * | 7/1999 | Witinski et al. | 4/496 |
| 6,113,009 | A | | 9/2000 | Chih | 239/394 |
| 6,123,272 | A | | 9/2000 | Havican et al. | 239/390 |
| 6,301,723 | B1 | | 10/2001 | Goettl | 4/490 |
| 6,367,098 | B1 | | 4/2002 | Barnes | 4/490 |
| 6,419,840 | B1 | | 7/2002 | Meincke | 210/767 |

* cited by examiner

*Primary Examiner*—Gregory Huson
*Assistant Examiner*—Huyen Le
(74) *Attorney, Agent, or Firm*—Kenehan & Lambertsen, Ltd.; John C. Lambertsen

(57) ABSTRACT

A wall mount return for pools and spas uses an eyeball fitting having a plurality of openings formed in its surface to selectively direct jets of water for better control of pool and spa water circulation patterns. Removable knockdowns are initially formed in each of the openings, and through their removal, permit customization of water directional flow for a particular return location. An inner directional ring formed within the eyeball fitting cooperates with the outer openings to enable the direction of water jets at non-perpendicular angles to the outer eyeball surface.

34 Claims, 5 Drawing Sheets

RETURN JET FITTING FOR POOLS AND SPAS

CROSS REFERENCE TO RELATED APPLICATIONS

This application claims the benefit of U.S. Provisional Patent Application, Ser. No. 60/327,966, filed Oct. 9, 2001.

BACKGROUND OF INVENTION

1. Field of the Invention

The present invention relates to a return jet fitting, and more particularly, for such a fitting as provides a more efficient circulation of return water in swimming pools and spas. More specifically, the present invention relates to an eyeball fitting that may be modified on site to obtain a desired water circulation pattern.

2. Description of the Prior Art

Pools and spas require additional cleaning beyond what occurs as a result of in-line filtration of the water as it circulates. In addition to using skimmers to remove floating debris, traditionally suction has been used to remove dirt, leaves, and the like from the shell (inner walls, coves, steps and floor). One of the earliest tools applied suction through a cleaning head attached to a long pole. A flexible hose connected the cleaning head to the skimmer, drawing in water and debris through the head for discharge into the general pool filtration system.

Manual cleaners require both the time and effort of the pool/spa owner or the hiring of a pool man. One solution has been the development of several types of "automatic cleaners." These are typically connected to a pressurized source of water that both powers its movement and creates the suction for cleaning. Early versions required water of higher pressure than is normally provided by the general circulation pumps; however, present devices, such as those offered under the KREEPY KRAULY® brand, are more efficient and do not require a separate source of high-pressure water.

Although no additional booster pumps are required by the more modern automatic cleaning systems, their cleaning operation continues only during operation of the general circulation pumps. The long hours of pump operation required to achieve a reasonable level of cleaning represent a significant energy cost for all but the smallest of pools.

An alternate technique relies upon a system of specialized return line fittings and active drains. The fittings direct currents of water to flow the debris towards active drain locations. These drains open during a cleaning mode, permitting the removal of water and entrained debris that had been directed to the general area by the generated water currents. Timed valves and other control mechanisms coordinate fitting flow and drain openings to maximize system efficiency. Many of these systems also require additional pumps and circulation systems to operate effectively.

This complexity comes at a price of increased installation and maintenance costs. Additionally, it is economically not possible to retrofit these systems into existing pools. Other cleaning systems have evolved intending to make use of the general circulation system in a manner similar to the more complex flow and drain systems.

In most systems, the general water circulation begins with removal of pool or spa water from a bottom main drain. Water flows to the pump and after filtration and heating (when required); the water is returned through ¾–3 inches piping to the pool or spa. Where the pool is of gunite, fiberglass or vinyl construction, a return loop line is provided about the perimeter of the pool. Tees are provided along the loop line to connect a pipe that extends through the pool wall these pipes are identified as the "return lines," and enter the pool approximately 9–14 inches below the intended water line. An average-sized pool will have 4–6 of such return lines.

The conventional return heads, known as "eyeball fittings," provide an outflow stream that circulates only the top 1–18 inches of water in a 6 foot deep pool. The main drain draws water from only 1 foot away, leaving a 4–5 foot (vertical) area of water that is "dead" in terms of circulation. As a result, chemical and thermal conditioning of the pool water require more time to accomplish, which means longer operation of the electric pump.

The teachings of Johnson, U.S. Pat. No. 4,520,514, suggest a very specialized return fitting that includes a bottom slot for directing a stream of water downward, along the pool wall. Some of the more generally available eyeball fittings include modifications such as a "slotted eyeball" and a "pulsator eyeball" each intended to provide variations on the straight-ahead stream of water and the resultant dead (circulation) areas.

Elimination of this dead area of poor water circulation requires a concerted effort in terms of return water flow and direction. The specialized return line fittings and active drains achieves greater mixing but at a cost of greatly increased complexity and expense. A need exists to obtain better pool circulation that makes use of an existing water circulation system, and in a manner that permits retrofitting to existing pools and spas.

SUMMARY OF INVENTION

It is an object of the present invention to provide a replacement eyeball fitting for pool and spa return lines that enables greatly increased circulation efficiency within pools and spas, permitting more effective cleaning of interior pool surfaces (including benches, floors, coves, and steps) during the operation thereof.

In this regard, an eyeball fitting has been modified to permit jetting up to 80% of the water volume down to the pool floor, through the dead water zone. A plurality of potential jet openings are molded into the eyeball fitting, permitting their selective removal on site, based upon the direction of water flow required at a specific return fixture location.

Using the jet openings appropriate for a particular location results in an uncompromised surface circulation, yet provides a turn rate to the overall pool or spa water volume that enables pool heating in 70% of the time previously required. Additionally, when used with a roving suction cleaning device, this improved circulation permits full cleaning in 2–3 hours, instead of the 8–12 hours previously required. Such improved circulation also results in less treatment chemicals required to saturate the total water volume.

While normal circulation of water in a 12,000 gallon pool might require 7 to 8 hours before a satisfactory treatment chemical level is achieved, the controlled direction of water possible with the modified eyeball fittings permits full circulation in approximately 3 ½ hours. Additional dead circulation zones formed by pool shape and circulation patterns can also be addressed with the present, modified eyeball fitting. For example, pools with curved surfaces can form dead zones cut off from the general surface circulation. It is possible to remove selective other of the potential fitting openings to permit water to be jetted to both the right and left, simultaneously with the directing of water downward, to clean steps, benches, walls, coves, and floor, as previously discussed.

These objects, as well as other objects and advantages of the present invention will become readily apparent upon review of the description of a non-limiting illustrative embodiment and the accompanying drawings.

DETAILED DESCRIPTION

Figure 1:
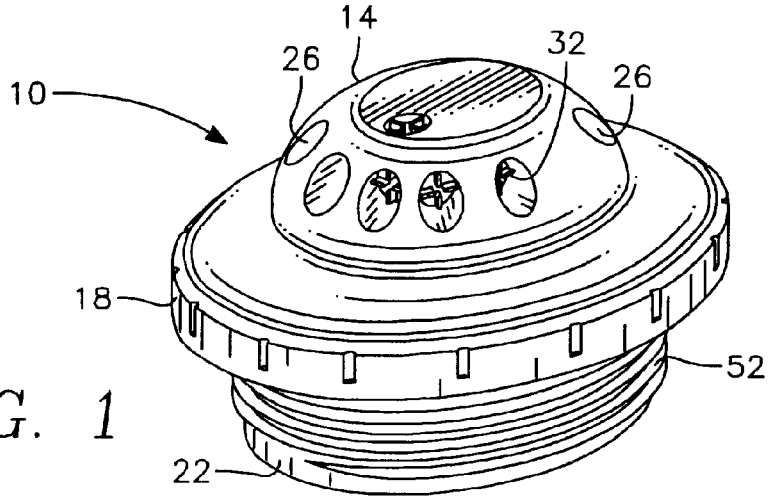
FIG. 1 is a perspective view showing an eyeball fitting retained within a return wall fitting assembly in accordance with the present invention.

Reference is now made to the drawings wherein like numerals refer to like parts throughout. In FIG. 1, a water return fitting 10 is shown, with a generally spherical eyeball fitting 14 retained by a lockdown ring 18 within a wall fitting 22. The eyeball fitting 14 is provided a plurality of jet openings 26, with a frangible knockout 32 formed in each.

Figure 2:
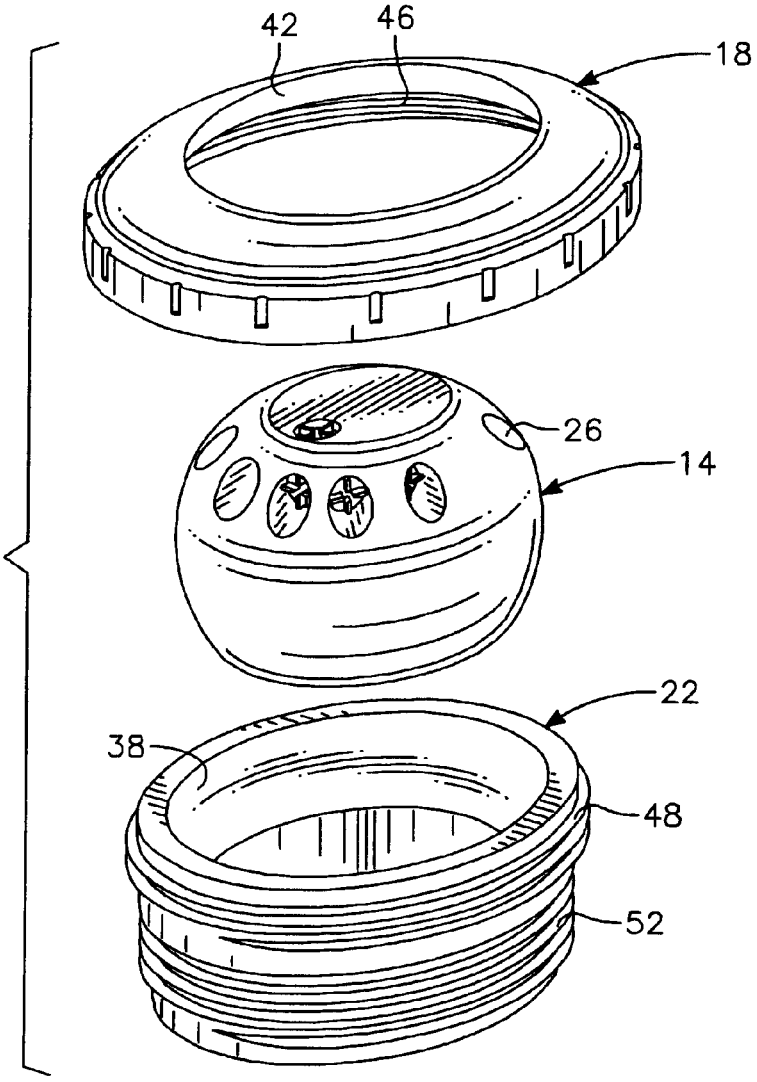
FIG. 2 is an exploded view, in perspective, showing the manner in which an eyeball fitting is received within a return wall fitting assembly in accordance with the present invention.

As is best shown by FIG. 2, the eyeball fitting 14 has the general shape of an oblique spheroid. A lower spherical surface is receive by a lower seating ring 38 formed in an upper surface of the wall fitting 22. An upper spherical surface of the eyeball fitting 14 is retained by an upper seating ring 42 formed in the lockdown ring 18. When properly positioned, a set of ring retaining threads 46 of the lockdown ring 18 are received by a set of outer housing threads 48 formed on the wall fitting 22. A set of housing retaining threads 52, which are also formed on an outer surface of the wall fitting 22, are utilized to install the wall fitting 22 in an opening of a return pipe (not shown in FIG. 2).

Upon sufficient tightening, the eyeball fitting 14 is rigidly clamped between the pair of seating rings 38, 42. Although the orientation of the eyeball fitting 14 later can be changed by loosening of this connection, in a preferred embodiment of the present invention it is contemplated that the majority of water jet adjustments will be made through the selective removal of the frangible knockouts 32 as will be hereinafter discussed.

Figure 3:
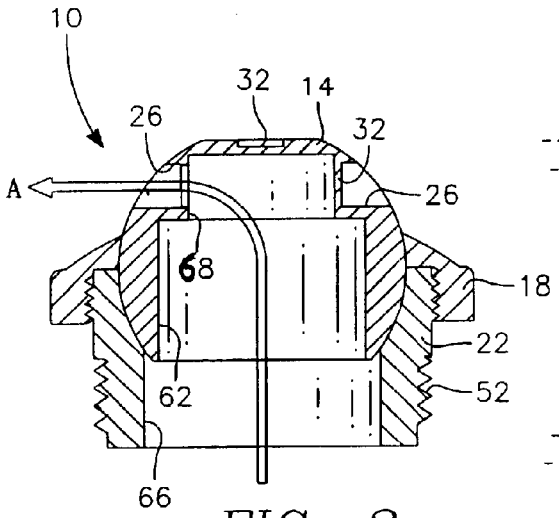
FIG. 3 is a cross-sectional view of an eyeball fitting and return wall fitting with a water flow arrow depicted therein.

FIG. 3 illustrates a water flow pathway A through the water return fitting 10. Entering from the return pipe (not shown in FIG. 3), the water enters and fills an inner cavity 62 formed within the eyeball fitting 14 and an adjacent inner cavity area 66 of the wall fitting 22. An inner directional ring 68 is formed in a forward section of the inner eyeball cavity 62.

With the inner eyeball cavity 62 filled with pressurized water, the direction flow out of the eyeball cavity 62 will be perpendicular to any opening in the cavity. The manner of retention using the lockdown ring 18 precludes positioning the plurality of jet openings 26 in the equator of the eyeball fitting 14. Absent the inner directional ring 68, the forward-.location of the jet openings 26 would result in a water flow directed primarily forward (straight out) from the location of the water return fitting 10.

The inner directional ring 68 forms a cylindrical surface, with a perpendicular that is directed substantially laterally in comparison to the orientation of the eyeball fitting 14. By formation of the jet openings 26 in the wall of the inner directional ring 68, upon removal of one or more knockouts 32, the flow of water A from the eyeball fitting 14 is substantially lateral with respect to the water return fitting 10 whether directed downward or to either side thereof.

Figure 4:
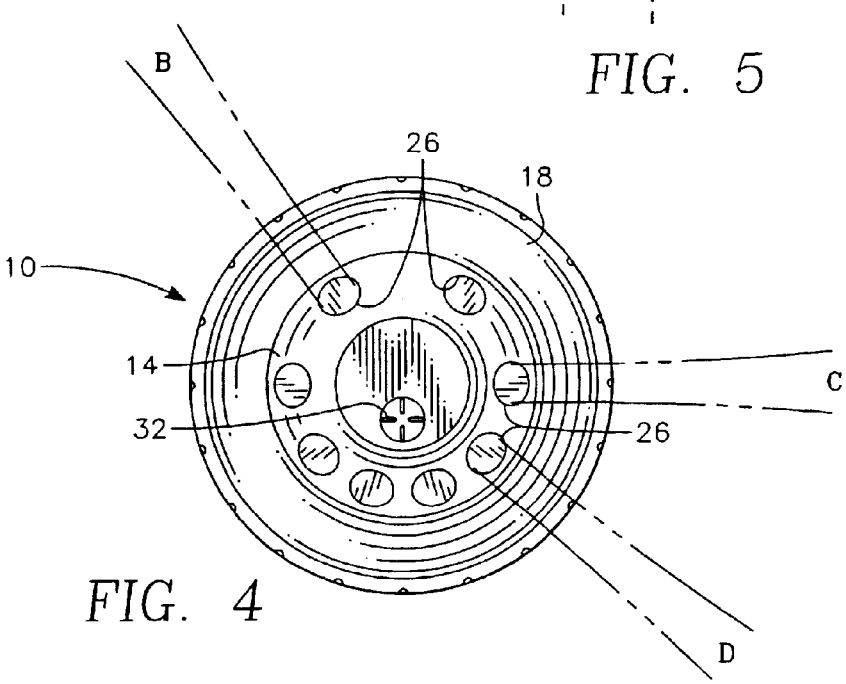
FIG. 4 is a top plan view, with portions in phantom, depicting possible water jets emerging from an eyeball fitting in accordance with the present invention.

Shown from a different perspective in FIG. 4, the water return fitting 14 has been adapted for a specific location through the removal of three knockouts 32. As a result, a directional array consisting of three streams of water, identified by the letters "B,""C," and "D," are shown (in phantom) projecting from three of the jet openings 26 of the eyeball fitting 14. Of course, these three streams are exemplary only, a greater or lesser number may be appropriate for a specific location of the water return fitting 10.

Figure 5:
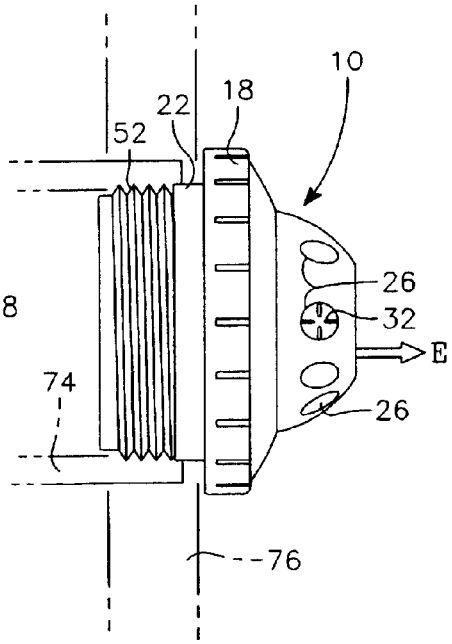
FIG. 5 is side elevation view, with portions in phantom, showing a manner of mounting an eyeball fitting and return wall fitting in a pool wall.

As discussed earlier, water returns are normally provided along the side walls of pools and spas. FIG. 5 depicts one such attachment of the water return fitting 10 to a return pipe 74 that is mounted in a pool wall 76. In this particular embodiment, the housing retaining threads 52 are received by matching threads formed on an inside surface of the return pipe 74. Once received and secured within the return pipe 74, the eyeball fitting 14 is appropriately positioned and the lockdown ring 18 is tightened. The appropriate knockouts 32 are removed, and in FIG. 5, the result is a flow of water directly out from the water return fitting 10 that is identified by the letter "E".

Figure 6:
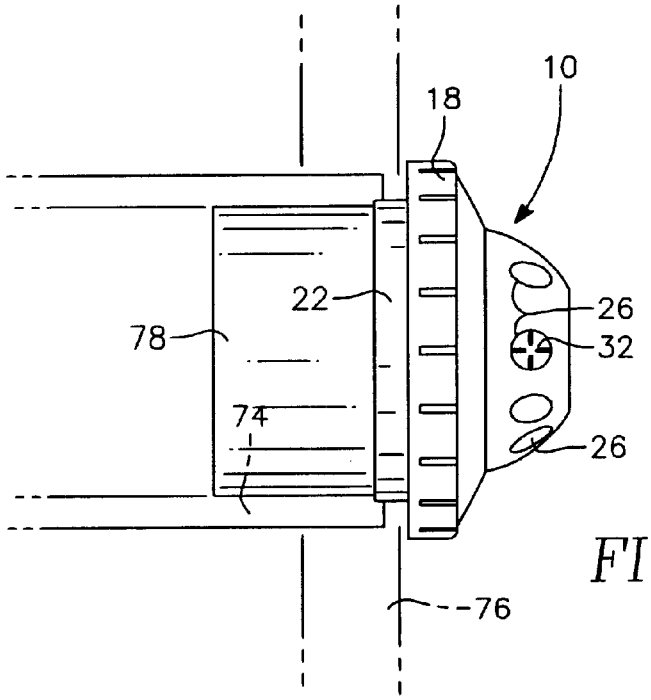
FIG. 6 is a side elevation view, with portions in phantom, similar to FIG. 4, showing an alternate manner of mounting an eyeball fitting and return wall fitting in a pool wall.

An alternative method for attached the water return fitting 10 to the return pipe 74 is illustrated in FIG. 6. The wall fitting 22 is provided a tapered fitting 78 that is received within the return pipe 74. Ideally, the tapered fitting 78 is suitably dimensioned to obtain an interference fit with the return pipe 74. The connection can be made permanent with the use of a suitable adhesive.

Figure 7:
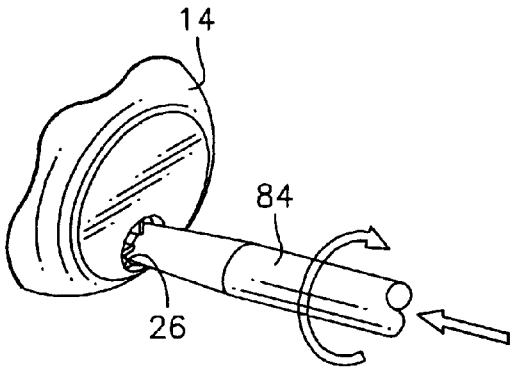
FIG. 7 is a partial, enlarged perspective view showing an initial step in removing a knockout from an eyeball fitting in accordance with the present invention.
Figure 8:
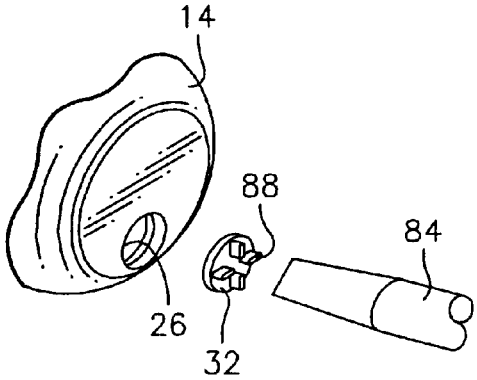
FIG. 8 is a partial, enlarged perspective view, similar to FIG. 6, showing a knockout after removal from an eyeball fitting.

As has been mentioned previously, the majority of water flow adjustments are made by removing the knockout 32 from one or more jet openings 26. One manner of doing so is illustrated in FIGS. 7 and 8. A tool 84, such as a screwdriver, is inserted in the jet opening 26 (FIG. 7). Using a combination punching and then twisting motions, the knockout 32 is removed from the jet opening 26, permitting water to exit from that opening during operation of the water circulating system.

The process of removal essentially destroys the knockout 32, unlike what is depicted in FIG. 8. However, the structure of the knockout 32 is best shown therein, and a plurality of fracture vanes 88 are depicted as projecting from the outer face of the knockout 32. Such projections interact with the tool to provide a cleaner removal of the knockout 32 from within the jet opening 26. In a preferred embodiment there are four orthogonally directed fracture vanes 88 centered on each of the knockouts 32.

Figure 9:
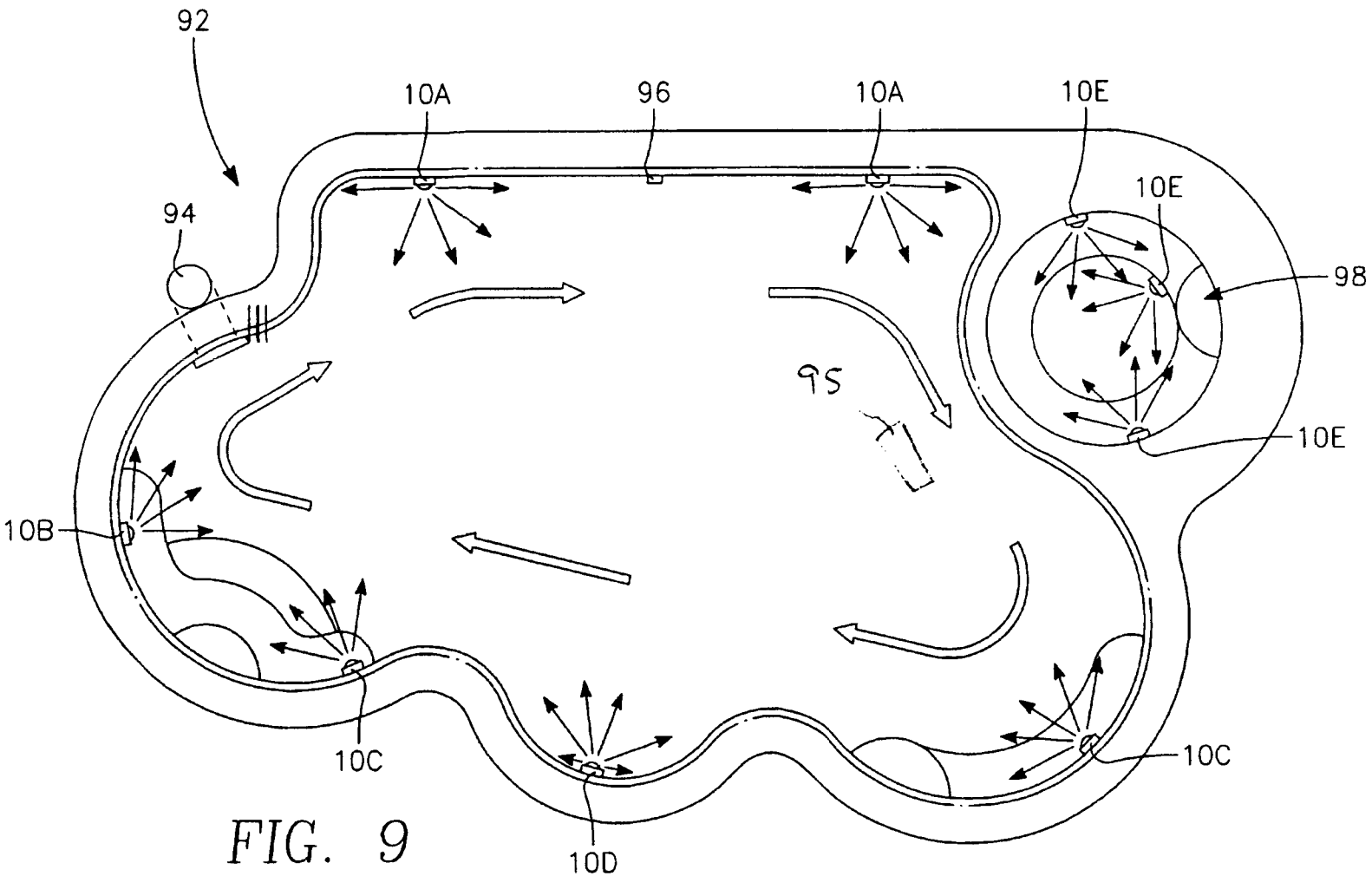
FIG. 9 is a top plan view showing a swimming pool and spa with water circulation patterns schematically depicted therein.

The manner in which the water return fittings 10 operate in the context of a pool or spa water circulation system is best shown in FIG. 9. A swimming pool and spa 92 with a skimmer system 94 and a main drain 95 is shown with the direction of water flow schematically depicted by arrows, the broader arrows showing a general clockwise water circulation, which, from the perspective of the individual water return fittings 10 is considered to be a "right" circulation.

Figure 10A:
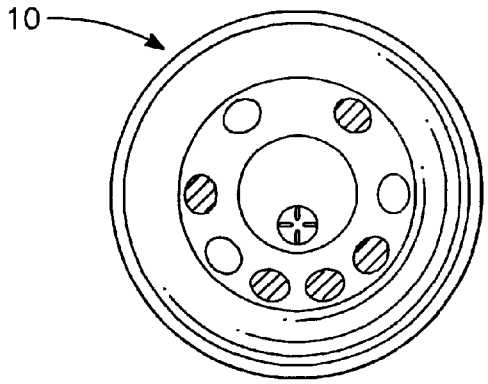
FIGS. 10A 10E are top plan views of eyeball fittings having one or more knockout sections removed to obtain different water jet patterns in accordance with the present invention.
Figure 10B:
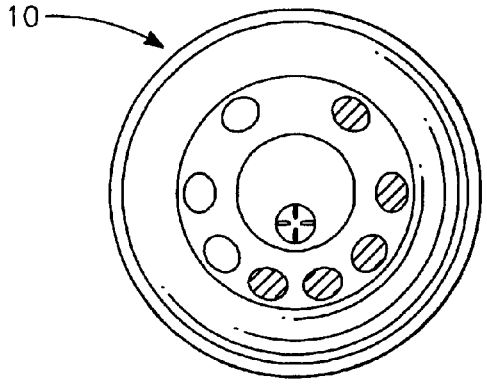
Figure 10C:
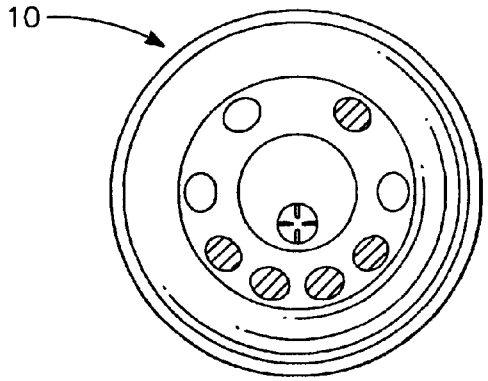
Figure 10D:
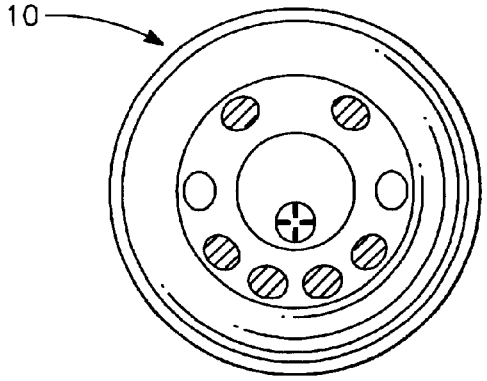
Figure 10E:
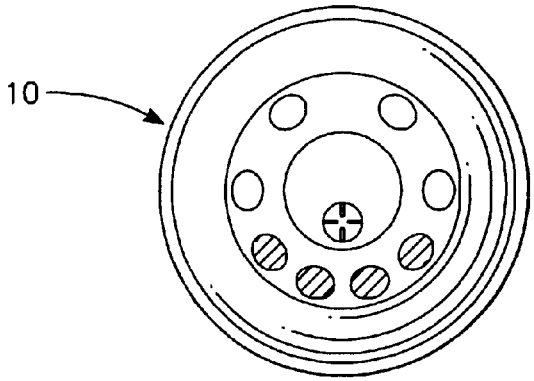

The solid arrows depict the water flow from their adjacent water return fitting 10. FIGS. 10A 10E are provided to correlate the solid arrow water flow with the identity of the knockouts 32 required to obtain such a flow pattern. The jet openings 26 having missing knockouts 32 are depicted by shading. It is from these shaded openings, which together constitute a directional array of openings that a flow of water will occur upon activation of the water circulation pump.

For purposes of clarity, the reference number associated with each water return fitting will include the letter of FIG. 10 associated with that flow pattern. As an example, the water return fitting 10A positioned immediately adjacent the skimmer 94 is appropriately located to provide a right surface circulation, a left side circulation to address a dead water spot due to pool curvature. Additionally, fitting 10A also includes 3 down jets to better circulate the water throughout the pool for reasons previously discussed.

Continuing towards the right, the pool includes an automatic cleaner attachment fitting 96, which functions as a water supply outlet for an optional (not shown) cleaner such as those provided under the KREEPY KRAULY® brand. Continuing down current is another water return fitting 10A, providing an identical flow pattern to that just discussed. The reasoning for the selected jet openings 26 includes a required surface jet directing surface flow to the right, and a left lateral jet to circulate water along the flat wall and minimize the opportunity for algae growth. The remaining three open jets are directed down to increase the rate of water turn.

A spa 98 forms part of the swimming pool and spa 92. Not only is the spa symmetric in shape, its size does not require the establishment of a left or right circulation pattern. Consequently, the water return fittings 10E are all identical, and feature all down jets to sweep the seating and foot well areas.

Returning to the pool, and continuing to the right, the water return fitting 10C is located above some steps and thus four down jets are used to scour the steps using the flow of water. Additionally, a right surface jet has been opened to maintain the general right pool circulation.

The next water return fitting 10D is located in a cove area, as formed by the pool wall curvature, and in addition to 4 down jets for general pool circulation, both left and right surface jets are active. The right jet maintains the general pool circulation to the right. The left jet addresses a dead water issue resulting from the interaction between the cove shape and the general circulation of surface water to the right.

The next two water return fittings 10B provide a single surface jet to the right for general water circulation and 4 down jets with a bias towards right water movement, in both cases to direct water over some adjoining pool steps. In this manner the general step area is kept substantially free of debris.

The water return fitting of the present invention is preferably fabricated out of ABS plastic, although other plastics, such as PVC, are acceptable, along with wood or metal. The material thickness ranges from ⅛–¼ inch when using ABS and injection molding to form the fitting. Generally spherical in shape, having a diameter of 1 ½ inches, with approximately ¼ inch removed from the base, leaving an opening of diameter approximately 1 ⅛ inches that is placed to generally face the return pipe when the return fitting is installed. Approximately 1/16 of the opposite end is also removed, leaving a solid disk of approximately ⅞ inches in diameter. One knockout or punch out of ⅜ inches in diameter is formed in this flat frontal face.

A plurality of additional knockouts are formed in the spherical surface approximately ¼ inch from the plane of the front disk. In a presently preferred embodiment, six of the knockouts and associated jet openings (each having a diameter of ¼ inches) are equally spaced across half of the circumference, and two knockouts/jet openings are spaced across the remaining half circumference. The knockout disk is approximately ⅛ inch in thickness, with the fracture vanes projection approximately 1/16 inch above the remaining planar surface.

The interior portion of the water return fitting defines the inner eyeball cavity, and broadly resembles two concentric containers, the first of diameter 1.161 inches and height (from the large opening) of slightly greater than ¾ of an inch, and the second of smaller diameter 0.867 inches and height (from the terminus of the first container) of 0.372 inches. This latter dimension is the height of the inner directional ring, and it is from this surface that the jet openings project to the sphere surface.

The foregoing dimensions are for a particular sized eyeball fitting that is designed to be accommodated by widely-used (and available) wall fittings. When so dimensioned, the normal operating environment contemplates pressure and flow rates in the range of 14 psi and 12 ½ gallons per minute if only one knockout is removed, up to 7 gallons per minute if all nine are active. Larger sizes can accommodate increased pressures and flow rates.

My invention has been disclosed in terms of a preferred embodiment thereof, which provides a pool and spa return jet fitting that is of great novelty and utility. Various changes, modifications, and alterations in the teachings of the present invention may be contemplated by those skilled in the art without departing from the intended spirit and scope thereof. It is intended that the present invention encompass such changes and modifications.

What is claimed is:

1. A fitting for a swimming pool or spa return line comprising:

a generally spherical housing having an interior cavity formed therein and an opening formed in an outer surface thereof, said interior cavity and said opening in fluid communication with one another, said outer surface further having at least one jet opening formed therein;

an inner directional ring formed in an outer wall of and projecting into said interior cavity, said at least one jet opening extending from said outer surface and into said interior cavity through said inner directional ring; and a frangible knockout formed within said at least one jet opening and obstructing fluid communication between said jet opening and said interior cavity.

2. A fitting according to claim 1, wherein a plurality of jet openings are formed in said outer surface of said spherical housing.

3. A fitting according to claim 2, wherein said frangible knockout is formed within each of said plurality of jet openings.

4. A fitting according to claim 2, wherein said frangible knockout is formed in a select few of said plurality of jet openings.

5. A wall fitting for a swimming pool or spa return line comprising:

an eyeball fitting having an inner cavity with an inner directional ring formed therein, said inner directional ring configured in a manner providing an inner cylindrical surface within the inner cavity of said eyeball fitting, said eyeball fitting further having a jet opening formed in an outer surface thereof;

a flow passageway through said inner directional ring and said jet opening to direct a jet of water from said eyeball fitting;

a wall fitting housing having a housing cavity formed therein of a configuration generally conforming to an outer surface of said eyeball fitting, said wall fitting further having an extension on one end thereof receivable in an outlet end of said return line for securement thereto;

a lockdown ring selectively engageable with said wall fitting housing and having an upper seating ring formed therein of a configuration conforming to an outer surface of said eyeball fitting;

a plurality of jet openings formed in said outer surface of said eyeball fitting and a plurality of flow passageways extending from said inner cylindrical surface of said inner directional ring, each of said jet openings in fluid communication with one of said plurality of flow passageways; and a selectively removable knockdown formed in one or more of said jet openings in a manner blocking one or more flow passageways, whereby said eyeball fitting is received within said wall fitting housing and secured thereto by said lockdown ring, and the selective removal of one or more of said knockdowns enables a corresponding one or more jets of water from said eyeball fitting.

6. A wall fitting according to claim 5, wherein said plurality of jet openings form an array.

7. A wall fitting according to claim 6, wherein said plurality of jet openings form a directional array.

8. A wall fitting according to claim 7, wherein the selective removal of one or more of said knockdowns provides a directional array of one or more jets of water.

9. A fitting for a swimming pool or spa return line comprising:

a generally spherical housing having an interior cavity formed therein and an opening formed in an outer surface thereof, said interior cavity and said opening in fluid communication with one another, said outer surface further having at least one jet opening formed therein; and an inner directional ring formed in an outer wall of and projecting into said interior cavity in a manner forming a substantially cylindrical surface, said at least one jet opening extending from said outer surface and into said interior cavity through said substantially cylindrical surface of said inner directional ring in a direction substantially perpendicular thereto.

10. A fitting according to claim 9, and further comprising a frangible knockout formed within said at least one jet opening and obstructing fluid communication between said jet opening and said interior cavity.

11. A fitting according to claim 10, wherein a plurality of jet openings are formed in said outer surface of said spherical housing.

12. A fitting according to claim 11, wherein said frangible knockout is formed within each of said plurality of jet openings.

13. A fitting according to claim 11, wherein said frangible knockout is formed in a select few of said plurality of jet openings.

14. A fitting according to claim 9, wherein said inner directional ring is continuous about an inner circumference of said interior cavity.

15. A fitting according to claim 9, and further comprising a wall fitting selectively receiving and retaining said general spherical housing.

16. A fitting according to claim 15, wherein a cylindrical extension is formed on a portion of said wall fitting of dimension receivable within said return line.

17. A fitting according to claim 16, wherein a plurality of threads are formed in an outer surface of said cylindrical extension.

18. A fitting according to claim 16, wherein said outer surface of said cylindrical extension is tapered.

19. A wall fitting for a swimming pool or spa return line comprising:

an eyeball fitting having an inner cavity with an inner directional ring formed therein, said inner directional ring configured in a manner providing an inner cylindrical surface within the inner cavity of said eyeball fitting, said eyeball fitting further having a jet opening formed in an outer surface thereof;

a flow passageway extending from said inner directional ring in a direction substantially perpendicular to said inner cylindrical surface and in fluid communication with said jet opening to direct a jet of water from said eyeball fitting;

a wall fitting housing having a housing cavity formed therein of a configuration generally conforming to an outer surface of said eyeball fitting, said wall fitting further having an extension on one end thereof receivable in an outlet end of said return line for securement thereto; and a lockdown ring selectively engageable with said wall fitting housing and having an upper seating ring formed therein of a configuration conforming to an outer surface of said eyeball fitting, whereby said eyeball fitting is received within said wall fitting housing and secured thereto by said lockdown ring.

20. A wall fitting according to claim 19, and further comprising a plurality of jet openings formed in said outer surface of said eyeball fitting and a plurality of flow passageways extending from said inner cylindrical surface of said inner directional ring in a substantially perpendicular manner, each of said jet openings in fluid communication with one of said plurality of flow passageways.

21. A wall fitting according to claim 20, and further comprising a selectively removable knockdown formed in one or more of said jet openings in a manner blocking one or more flow passageways, whereby the selective removal of one or more of said knockdowns enables a corresponding one or more jets of water from said eyeball fitting.

22. A wall fitting according to claim 19, wherein said plurality of jet openings form an array.

23. A wall fitting according to claim 22, wherein said plurality of jet openings form a directional array.

24. A wall fitting according to claim 23, wherein the selective removal of one or more of said knockdowns provides a directional array of one or more jets of water.

25. A fitting for a swimming pool or spa return line comprising:

a generally spherical housing having an interior cavity formed therein and an opening formed in an outer surface thereof, said interior cavity and said opening in fluid communication with one another and defining a first orientation axis for said fitting, said outer surface further having at least one jet opening formed therein; and an inner directional ring formed in an outer wall of and projecting into said interior cavity, said at least one jet opening extending from said outer surface and into said interior cavity through said inner directional ring in a direction substantially perpendicular to said first orientation axis.

26. A fitting according to claim 25, and further comprising a frangible knockout formed within said at least one jet opening and obstructing fluid communication between said jet opening and said interior cavity.

27. A fitting according to claim 26, wherein a plurality of jet openings are formed in said outer surface of said spherical housing.

28. A fitting according to claim 27, wherein said frangible knockout is formed within each of said plurality of jet openings.

29. A fitting according to claim 27, wherein said frangible knockout is formed in a select few of said plurality of jet openings.

30. A fitting according to claim 25, wherein said inner directional ring is continuous about an inner circumference of said interior cavity.

31. A fitting according to claim 25, and further comprising a wall fitting selectively receiving and retaining said general spherical housing.

32. A fitting according to claim 31, wherein a cylindrical extension is formed on a portion of said wall fitting of dimension receivable within said return line.

33. A fitting according to claim 32, wherein a plurality of threads are formed in an outer surface of said cylindrical extension.

34. A fitting according to claim 32, wherein said outer surface of said cylindrical extension is tapered.

* * * * *